US006422770B1

(12) United States Patent
de la Reguera

(10) Patent No.: US 6,422,770 B1
(45) Date of Patent: Jul. 23, 2002

(54) UNIVERSAL INKED RIBBON ASSEMBLY FOR PRINTING APPARATUS

(75) Inventor: Deborah J. de la Reguera, Palatine, IL (US)

(73) Assignee: Nashua Corporation, Nashua, NH (US)

( * ) Notice: Subject to any disclaimer, the term of this patent is extended or adjusted under 35 U.S.C. 154(b) by 0 days.

(21) Appl. No.: 09/618,531

(22) Filed: Jul. 18, 2000

(51) Int. Cl.[7] ..... B41J 35/28

(52) U.S. Cl. ..... 400/208; 400/236; 400/242; 400/246; 400/693.1; 242/597.6; 242/599.4

(58) Field of Search ..... 400/207, 208, 400/236, 246, 242, 693.1; 242/599, 597.6, 599.4, 600, 613, 609.1

(56) References Cited

U.S. PATENT DOCUMENTS

| | | | | |
|---|---|---|---|---|
| 4,915,516 A | * | 4/1990 | Shimizu et al. | 400/120 |
| 4,978,240 A | * | 12/1990 | Katsuno | 400/224.2 |
| 5,022,771 A | * | 6/1991 | Paque | 400/120 |
| 5,100,250 A | * | 3/1992 | Suzuki et al. | 400/208 |
| 5,584,587 A | | 12/1996 | Koike et al. | |
| 5,775,821 A | | 7/1998 | Kato | |
| 5,897,256 A | | 4/1999 | Kameyama | |
| 5,913,621 A | | 6/1999 | Kameyama et al. | |
| 6,161,972 A | * | 12/2000 | Kameyama et al. | 400/208 |
| 6,257,780 B1 | * | 7/2001 | Ito et al. | 400/208 |

FOREIGN PATENT DOCUMENTS

| | | |
|---|---|---|
| EP | 5-270089 | 10/1993 |
| JP | 61-51380 | 3/1968 |
| JP | 61-54969 | 3/1986 |
| JP | 61-222772 | 10/1986 |

* cited by examiner

*Primary Examiner*—Andrew H. Hirshfeld
*Assistant Examiner*—Kevin D. Williams
(74) *Attorney, Agent, or Firm*—Wood, Phillips, Katz, Clark & Mortimer

(57) ABSTRACT

An inked ribbon assembly for use with a printing apparatus such as a thermal facsimile machine includes a generally cylindrical supply spool, a generally cylindrical take-up spool, and a sheet-like inked ribbon extending therebetween, with the inked ribbon rolled upon the supply spool and connected to the take-up spool for advancement through the printing apparatus to the take-up spool. The spools of the inked ribbon assembly are rotatably supported in the printing apparatus by support spindles, which effect driven rotation of the supply and take-up spools. The support spindles each include one or more drive lugs which engage the spools of the ribbon assembly for effecting advancement of the inked ribbon. Because the drive lug arrangement of support spindles for different printing apparatus can differ from one model machine to another, the spools of the present inked ribbon assembly have been provided with a specifically configured arrangement of spindle notches which facilitate use of the ribbon assembly in different printing apparatus having differing support spindle configurations.

8 Claims, 2 Drawing Sheets

UNIVERSAL INKED RIBBON ASSEMBLY FOR PRINTING APPARATUS

TECHNICAL FIELD

The present invention relates generally to an inked ribbon assembly for use in facsimile machines and like printing apparatus, and more particularly to an inked ribbon assembly which has been particularly configured to facilitate versatile application in a plurality of different printing apparatus having varying ribbon drive arrangements.

BACKGROUND OF THE INVENTION

A thermal printing apparatus, such as a facsimile machine, typically employs a rolled, sheet-like inked ribbon for effecting printing on associated paper. The ribbon typically is wound on a cylindrical supply spool, from which it extends to an associated cylindrical take-up spool. The ribbon is advanced through the printing apparatus during its operation, whereby ink on the surface of the ribbon is transferred to associated paper by the printing mechanism.

The printing apparatus includes a drive mechanism for the take-up and supply spools that moves the inked ribbon simultaneously with the advancement of associated paper, during which process the ink is transferred from the ribbon to the paper to create the desired image. To this end, the drive mechanism includes a plurality of support spindles, each insertable into a respective end of one of the spools, for rotatably supporting the spools in the printing apparatus.

In order to assure reliable advancement of the inked ribbon through the printing apparatus, the support spindles typically include one or more drive lugs for disposition in spindle notches defined by the respective ends of the take-up and supply spools. While the provision of such drive lugs on the support spindles is a common feature of various printing apparatus, the specific configuration of the drive lugs can vary from one manufacturer and one machine to another. As a consequence, an inked ribbon assembly configured for cooperation with the support spindles of one particular printing apparatus may not be suitably configured for use with a different apparatus, thus detracting from efficient manufacture and supply of replacement ribbon assemblies.

The present invention is directed to an inked ribbon assembly configured for "universal" application with a plurality of different printing apparatus, thus promoting efficient manufacturing and distribution of replacement ribbons.

SUMMARY OF THE INVENTION

An inked ribbon assembly embodying the principles of the present invention is configured for use with an associated thermal printing apparatus, such as a facsimile (fax) machine. To promote use of the ribbon assembly with different machines having differently configured support spindles, the present ribbon assembly includes spools which have been particularly configured for receiving, in driving relationship, differently configured support spindles. As such, the same ribbon assembly can be used in a variety of different printing apparatus, thus promoting efficient and economical manufacture, distribution, and storage of replacement ribbon assemblies.

In accordance with the present invention, an inked ribbon assembly for use with an associated printing apparatus includes a first ribbon supply spool having a generally elongated, cylindrical configuration having first and second opposite, open ends. The assembly further includes a second, take-up spool having a generally elongated, cylindrical configuration having third and fourth opposite, open ends. The third and fourth open ends of the take-up spool respectively correspond to the first and second open ends of the supply spool by being respectively aligned therewith when the spools are positioned in spaced apart, parallel relationship during use of the inked ribbon assembly.

The assembly includes an inked ribbon which extends between and is connected to the supply and take-up spools and which includes an ink-coated surface for effecting printing in cooperation with the associated printing apparatus. The sheet-like ribbon is rolled on the supply spool from which it is transferred to the take-up spool during operation of the printing apparatus.

Each of the first, second, third, and fourth ends of the supply and take-up spools are configured to receive a respective one of a plurality of associated support spindles for rotatably supporting the spools in the printing apparatus. Typically, at least one of the spindles for each of the spools includes gear teeth thereon which are driven by the printing apparatus for advancing the inked ribbon through the machine. Additionally, each of the support spindles includes one or more drive lugs which engage the respective one of the supply and take-up spools for effecting driven advancement of the inked ribbon during machine operation.

As noted, the support spindles of different machines, e.g., machines from different manufacturers, or different models of machines, may include drive lugs which are differently positioned on the drive spindles. In accordance with the present invention, the present inked ribbon assembly is specifically configured to accommodate disposition of such differently configured spindles in the ends of the supply and take-up spools. In particular, the first open end of the supply-spool defines a pair of diametrically opposed spindle notches for cooperation with an associated spindle inserted into the first open end. In contrast, the second open end of the supply spool defines a pair of diametrically opposed spindle notches, and further defines a third spindle notch positioned at right angles, relative to an axis of the supply spool, to the pair of diametrically opposed notches defined by the second open end. By this arrangement, a drive spindle having two drive lugs, spaced 180° apart, can be positioned in either of the first and second open ends of the supply spool. Additionally, a support spindle having two drive lugs positioned 90° apart can be fitted in driving relationship in the second open end of the supply spool.

The take-up spool of the present ribbon assembly is also configured in a fashion which facilitates cooperation with differently configured support spindles. The third open end of the take-up spool defines a pair of generally opposed spindle notches, one of which is relatively enlarged. The relatively enlarged one of the notches defined by the third open end is positioned asymmetrically with respect to the other of the spindle notches defined by the third end. The arrangement is configured such that one side of the enlarged one of the notches is spaced from the other notch for receipt of a support spindle having a pair of drive lugs spaced 180° apart. The other side of the enlarged notch is spaced from the other notch to also receive a support spindle having a pair of drive lugs spaced about 160° apart. Thus, by virtue of the asymmetrical positioning of the relatively enlarged spindle notch, relative to the other spindle notch defined by the third end, a support spindle having a pair of drive lugs spaced either 180° apart or 160° apart can be received in the third end of the take-up spool. In the preferred embodiment, the fourth open end of the take-up spool defines a pair of diametrically opposed spindle notches for cooperation with an associated support spindle inserted therein, with this arrangement facilitating receipt of a support spindle having drive lugs positioned 180° apart.

Other features and advantages of the present invention will become readily apparent from the following detailed description, the accompanying drawings, and the appended claims.

DETAILED DESCRIPTION

Figure 1:
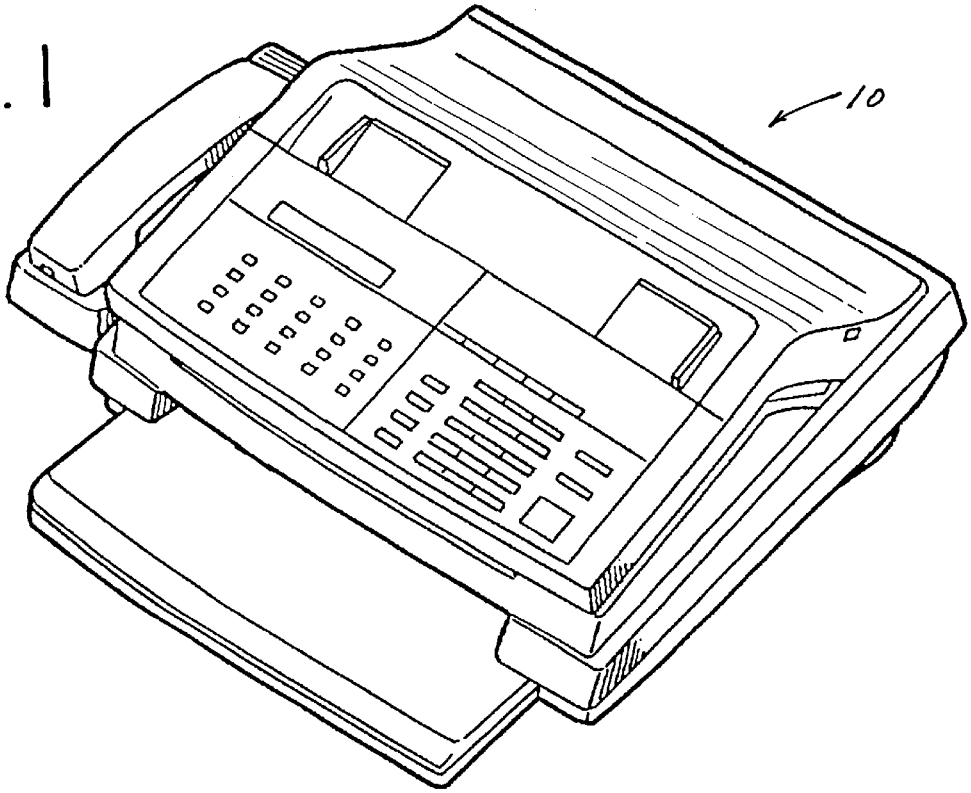
FIG. 1 is a perspective view of a printing apparatus, illustrated as a thermal facsimile machine, of the type for which the present invention is suited for use.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference first to FIG. 1, therein is illustrated a printing apparatus 10, illustrated as a thermal facsimile machine, of the type for which the present inked ribbon assembly is suited for use. Commercially available models of this type of printing apparatus are available from a number of different manufacturers, with specific models typically including differing features as may be required for specific applications. However, all of the models are similar in that they can be opened to receive an inked ribbon assembly, in accordance with the present invention, which provides an ink supply on a coated surface of the ribbon so that by cooperation with the apparatus, printing is effected on an associated paper. U.S. Pat. Nos. 5,775,821, 5,897,256, and 5,913,621, all hereby incorporated by reference, illustrate features of this type of printing apparatus, and inked ribbon arrangements for use therewith.

Figure 2:
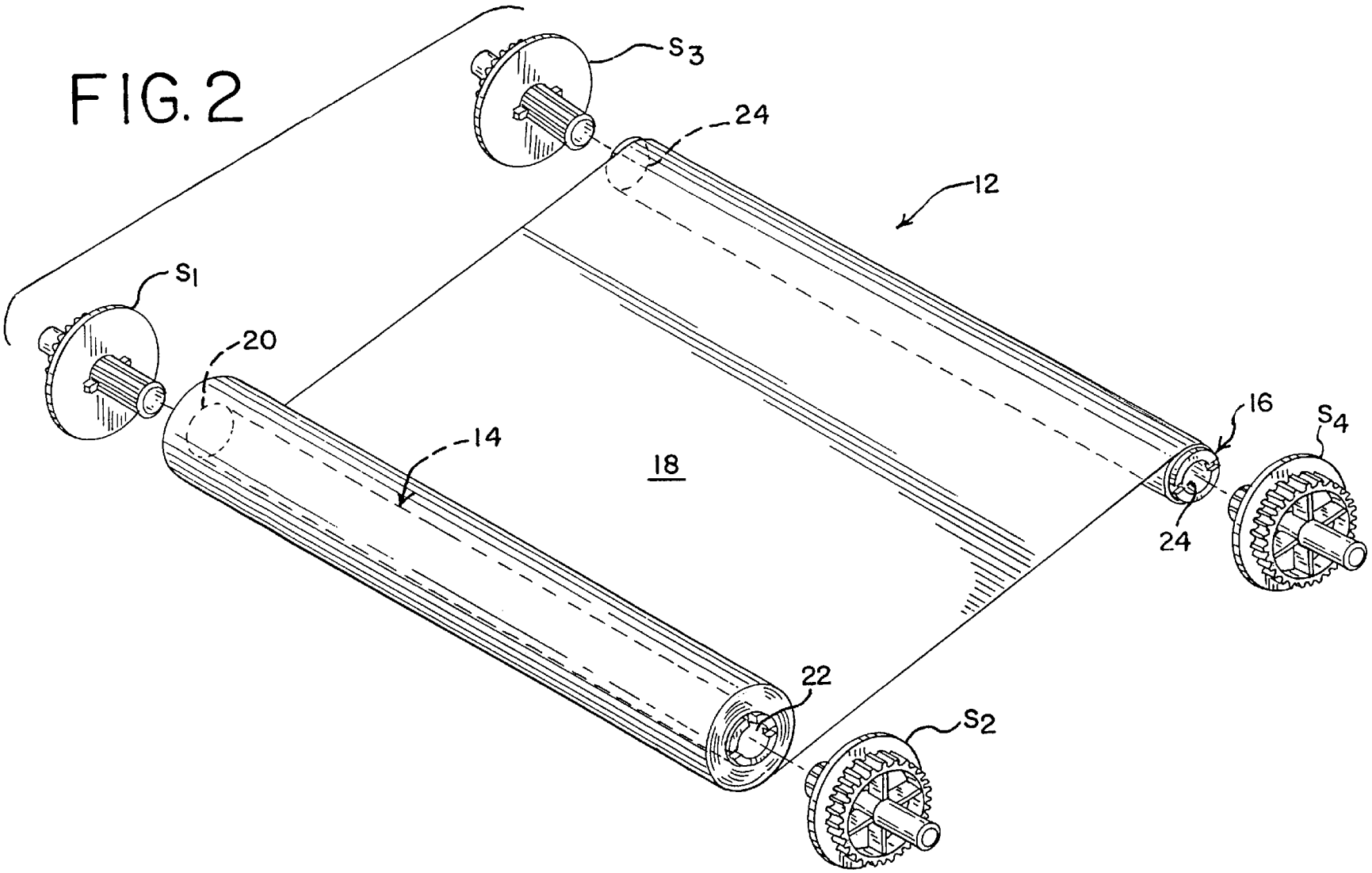
FIG. 2 is a perspective diagrammatic view of an inked ribbon assembly embodying the principles of the present invention, illustrated in association with a plurality of associated support spindles, which spindles are illustrated in an exemplary configuration.

With particular reference to FIG. 2, therein is illustrated an inked ribbon assembly 12 embodying the principles of the present invention. The ribbon assembly 12 is configured for operative disposition within the printing apparatus 10 illustrated in FIG. 1, with a plurality of support spindles, as will be further described, employed for rotatably supporting spools of the ribbon assembly in the printing apparatus. The support spindles cooperate with the printing apparatus for effecting driven rotation of the ribbon spools, thereby advancing the ribbon of the assembly through the printing apparatus as ink from the surface of the ribbon is transferred onto associated paper.

With further reference to FIG. 2, the ribbon assembly 12 includes a generally elongated, cylindrical supply spool 14, and a generally elongated, cylindrical take-up spool 16. A sheet-like inked ribbon 18 extends between the supply spool 14 and the take-up spool 16, with many number of feet of the inked ribbon 18 initially being wound on the supply spool 14. One surface of the inked ribbon 18 is coated with ink for cooperation with the printing apparatus 10, with the illustrated embodiment configured such that the ribbon is "coated side out" (CSO), that is, the ink-coated surface of the ribbon is positioned outwardly away from the axis of the supply spool 14.

As further illustrated in FIG. 2, a plurality of support spindles, designated $S_1$, $S_2$, $S_3$, and $S_4$, are configured for respective disposition in opposite open ends of the supply spool 14 and take-up spool 16. Specifically, the supply spool 14 defines a first open end 20 for receiving support spindle $S_1$, and a second, opposite open end 22 for receiving support spindle $S_2$ therein. Similarly, take-up spool 16 defines a third open end 24 for receiving support spindle $S_3$ therein, and an opposite, fourth open end 26 for receiving support spindle $S_4$.

In accordance with a typical configuration, at least one of the support spindles received by each of the supply and take-up spools includes a plurality of gear teeth which cooperate with the printing apparatus 10 for effecting driven rotation of the ribbon spools. In order to assure positive advancement of the ribbon through the printing apparatus, each of the support spindles further includes one or more drive lugs which engage the respective spool for effecting driven rotation thereof. Because the support spindles of different printing apparatus may have differently positioned drive lugs, the supply and take-up spools of the present inked ribbon assembly have been particularly configured to facilitate cooperation with such differently configured support spindles. As a consequence, versatile application of the present inked ribbon assembly is desirably achieved.

Figure 3:
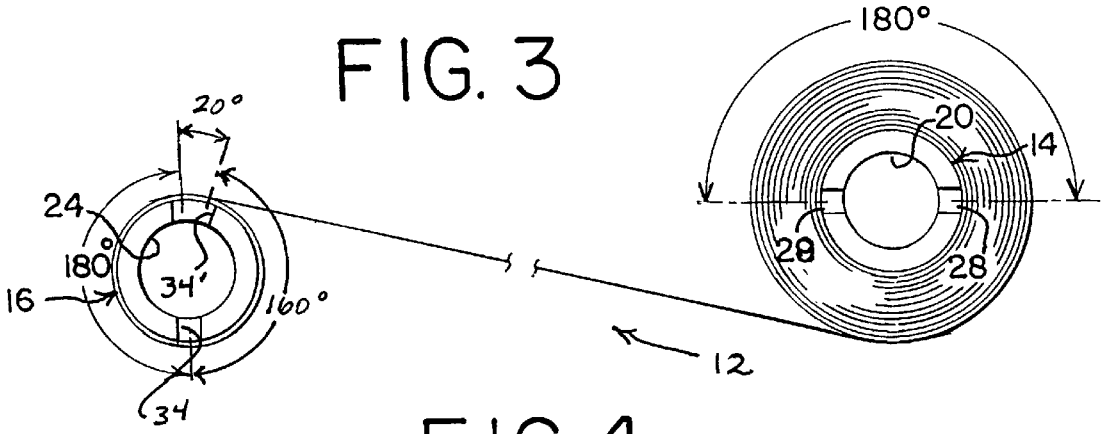
FIG. 3 is a diagrammatic side elevational view illustrating features of the present inked ribbon assembly which facilitate its use with differently configured support spindles.
Figure 4:
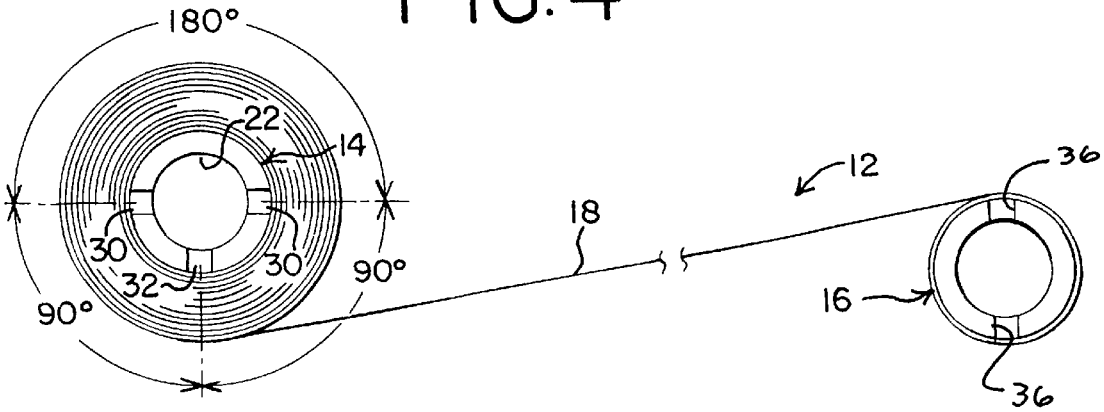
FIG. 4 is a view similar to FIG. 3 further illustrating features of the present inked ribbon assembly which facilitates it use with differently configured support spindles.

With particular reference to FIGS. 3 and 4, the opposite, open ends of each of the supply spool 14 and take-up spool 16 are illustrated. As will be observed in FIG. 3, the first open end 20 of supply spool 14 defines a pair of diametrically opposed spindle notches 28, positioned 180° apart (center-to-center), as illustrated. Thus, this end of the spool is configured to receive a support spindle having either a pair of diametrically opposed drive lugs, or a spindle having a single drive lug. (In a typical configuration, each drive lug has a circumferential dimension of about 3 mm.) In contrast, FIG. 4 illustrates second open end 22 of supply spool 14, which not only includes a pair of diametrically opposed spindle notches 30, but an additional, third spindle notch 32 positioned at right angles (relative to the axis of the supply spool) to the diametrically opposed spindle notches 30. By this arrangement, a support spindle having a pair of drive lugs positioned 180° apart, or a pair of drive lugs positioned 90° apart, can be received in driving relationship within the second end of the supply spindle (a supply spindle having a single drive lug can also be received therein).

The take-up spool 16 is similarly configured for versatile application with differently configured support spindles. With further reference to FIGS. 3 and 4, the third open end 24 of take-up spool 16 includes a pair of generally opposed spindle notches 34, 34'. As will be observed, spindle notch 34' is relatively enlarged, and extends slightly more than 20° relative to the axis of the take-up spool 16. As illustrated, the enlarged spindle notch 34' is positioned asymmetrically with respect to the other spindle notch 34, with one side of the enlarged notch 34' being positioned from the spindle notch 34 so that the pair of notches can respectively receive a pair of drive lugs of a support spindle positioned about 180° (center-to-center) apart. The other side of enlarged spindle notch 34' is positioned from the other spindle notch 34 so that the pair of notches can also respectively receive a pair of drive lugs of a support spindle positioned about 160°

(center-to-center) apart. By this configuration, a support spindle having a pair of drive lugs positioned 180° apart, or a support spindle having drive lugs positioned about 160° apart, can be received in driving relationship within the third end of the take-up spool 16.

FIG. 4 illustrates the fourth, opposite end of the take-up spool 16, at which a pair of diametrically opposed spindle notches 36 are defined. This open end of the spool can thus receive a support spindle having a pair of drive lugs positioned 180° apart, or a support spindle having a single drive lug.

Table 1 sets forth a matrix of spindle configurations, associated with different printing apparatus, for which the present inked ribbon assembly is suited for use. While this listing is not intended to be exhaustive, it will be apparent that the present ribbon assembly provides desirable versatility of application, thus promoting efficient and economical manufacture, distribution, and storage by obviating the need to provide differently configured inked ribbon assemblies for printing apparatus having differing support spindle configurations.

TABLE 1

| PRINTING | SPINDLE CONFIGURATION | | | |
|---|---|---|---|---|
| | Supply Spool | | Take-Up Spool | |
| PARAMETERS | left-hand end | right-hand end | left-hand end | right-hand end |
| [Ribbon path from bottom of supply spool to top of take-up spool] | | | | |
| Model A | 2 lugs spaced 90° | 2 lugs spaced 180° | 2 lugs spaced 180° | 2 lugs spaced 180° |
| Model B | 2 lugs spaced 90° | 2 lugs spaced 180° | 2 lugs spaced 180° | 2 lugs spaced 180° |
| [Ribbon path from top of supply spool to bottom of take-up spool] | | | | |
| Model C | 2 lugs spaced 180° | 2 lugs spaced 180° | 2 lugs spaced 160° | 2 lugs spaced 180° |
| Model D | 2 lugs spaced 180° | 2 lugs spaced 180° | 2 lugs spaced 160° | 2 lugs spaced 180° |

From the foregoing, numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. An inked ribbon assembly for use with an associated printing apparatus, comprising:

a first ribbon supply spool having a generally elongated configuration having first and second opposite, open ends;

a second take-up spool having a generally elongated configuration having third and fourth opposite, open ends, respectively corresponding to said first and second open ends of said supply spool; and an inked ribbon extending between said supply and take-up spools, said inked ribbon having an ink-coated surface for effecting printing in cooperation with said associated printing apparatus, each of said first, second, third, and fourth open ends of said supply and take-up spools being configured to receive a respective one of a plurality of associated support spindles for rotatably supporting said spools in said printing apparatus, said first open end defining a pair of diametrically opposed spindle notches for cooperation with an associated spindle inserted into the first open end;

said second open end defining a pair of diametrically opposed spindle notches, and further defining a third spindle notch positioned at right angles relative to an axis of said supply spool, to said pair of diametrically opposed spindle notches defined by said second open end, said third open end of said take-up spool defining a pair of generally opposed spindle notches, one of which is of an enlarged size relative to the size of the other one, said enlarged one of said notches defined by said third open end being positioned asymmetrically with respect to the other of said spindle notches defined by said third open end, said third open end thereby configured to receive associated support spindles having differently spaced apart drive lugs.

2. An inked ribbon assembly in accordance with claim 1, wherein:

said fourth open end of said take-up spool defines a pair of diametrically opposed spindle notches for cooperation with an associated spindle inserted into said fourth open end.

3. An inked ribbon assembly for use with an associated printing apparatus, comprising:

a first ribbon supply spool having a generally elongated configuration having first and second opposite, open ends;

a second take-up spool having a generally elongated configuration having third and fourth opposite, open ends, respectively corresponding to said first and second open ends of said supply spool; and an inked ribbon extending between said supply and take-up spools, said inked ribbon having an ink-coated surface for effecting printing in cooperation with said associated printing apparatus, each of said first, second, third, and fourth open ends of said supply and take-up spools being configured to receive a respective one of a plurality of associated support spindles for rotatably supporting said spools in said printing apparatus, wherein said third open end of said take-up spool defines a pair of generally opposed spindle notches, one of which is of an enlarged size relative to the size of the other one, said enlarged one of said notches defined by said third open end being positioned asymmetrically with respect to the other of said spindle notches defined by said third open end, one side of said enlarged one of said spindle notches is spaced from the other one of said spindle notches defined by said third open end so that the generally opposed notches can respectively receive a pair of drive lugs of an associated support spindle spaced about 180° apart, the other of said enlarged ones of said spindle notches being spaced from said other one of said spindle notches defined by said third open end so that the generally opposed notches can respectively receive a pair of drive lugs of an associated support spindle spaced 160° apart.

4. An inked ribbon assembly in accordance with claim 3, wherein:

said second open end defines a pair of diametrically opposed spindle notched notches defined by said second open end.

5. An inked ribbon assembly in accordance with claim 4, wherein:

said first open end defines a pair of diametrically opposed spindle notches for cooperation with an associated spindle inserted into the first open end, and said fourth open end of said take-up spool defines a pair of diametrically opposed spindle notches for cooperation with an associated spindle asserted into said fourth open end.

6. An inked ribbon assembly for use with an associated printing apparatus, comprising:

a first ribbon supply spool having a generally elongated configuration having first and second opposite, open ends;

a second take-up spool having a generally elongated configuration having third and fourth opposite, open ends, respectively corresponding to said first and second open ends of said supply spool; and an inked ribbon extending between said supply and take-up spools, said inked ribbon having an ink-coated surface for effecting printing in cooperation with said associated printing apparatus, each of said first, second, third, and fourth open ends of said supply and take-up spools being configured to receive a respective one of a plurality of associated support spindles for rotatably supporting said spools in said printing apparatus, said first open end defining a pair of diametrically opposed spindle notches for cooperation with an associated spindle inserted into the first open end;

said second open end defining a pair of diametrically opposed spindle notches, and further defining a third spindle notch positioned at right angles relative to an axis of said supply spool, to said pair of diametrically opposed spindle notches defined by said second open end, said third open end of said take-up spool defines a pair of generally opposed spindle notches, one of which is of an enlarged size relative to the size of the other one, said enlarged one of said notches defined by said third open end being positioned asymmetrically with respect to the other of said spindle notches defined by said third open end, one side of said enlarged one of said spindle notches is spaced from the other one of said spindle notches defined by said third open end so that the generally opposed notches can respectively receive a pair of drive lugs of an associated support spindle spaced about 180° apart, the other side of said enlarged one of said spindle notches being spaced from said other one of said spindle notches defined by said third open end so that the generally opposed notches can respectively receive a pair of drive lugs of an associated support spindle spaced 160° apart.

7. An inked ribbon assembly for use with an associated printing apparatus, comprising:

a first ribbon supply spool having a generally elongated configuration having first and second opposite, open ends;

a second take-up spool having a generally elongated configuration having third and fourth opposite, open ends, respectively corresponding to said first and second open ends of said supply spool; and an inked ribbon extending between said supply and take-up spools, said inked ribbon having an ink-coated surface for effecting printing in cooperation with said associated printing apparatus, each of said first, second, third, and fourth open ends of said supply and take-up spools being configured to receive a respective one of a plurality of associated support spindles for rotatably supporting said spools in said printing apparatus, wherein said third open end of said take-up spool defines a pair of generally opposed spindle notches, one of which is of an enlarged size relative to the size of the other one, said enlarged one of said notches defined by said third open end being positioned asymmetrically with respect to the other of said spindle notches defined by said third open end, said second open end defining a pair of diametrically opposed spindle notches, and further defining a third spindle notch positioned at right angles relative to an axis of said supply spool, to said pair of diametrically opposed spindle notches defined by said second open end, one side of said enlarged one of said spindle notches is spaced from the other one of said spindle notches defined by said third open end so that the generally opposed notches can respectively receive a pair of drive lugs of an associated support spindle spaced about 180° apart, the other side of said enlarged one of said spindle notches being spaced from said other one of said spindle notches defined by said third open end so that the generally opposed notches can respectively receive a pair of drive lugs of an associated support spindle spaced 160° apart.

8. An inked ribbon assembly in accordance with claim 7, wherein:

said first open end defines a pair of diametrically opposed spindle notches for cooperation with an associated spindle inserted into the first open end, and said fourth open end of said take-up spool defines a pair of diametrically opposed spindle notches for cooperation with an associated spindle asserted into said fourth open end.

* * * * *